US010319185B2

(12) United States Patent
Gagner et al.

(10) Patent No.: US 10,319,185 B2
(45) **Date of Patent: *Jun. 11, 2019**

(54) DYNAMIC UPDATING OF CONTENT BASED ON GAMING-APPLICATION CONTEXT

(71) Applicant: Bally Gaming, Inc., Las Vegas, NV (US)

(72) Inventors: Mark B Gagner, West Chicago, IL (US); Siva Kumar Krishnan, Bolingbrook, IL (US); Larry J Pacey, Northbrook, IL (US); Alfred Thomas, Las Vegas, NV (US); Matthew J Ward, Northbrook, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/676,574

(22) Filed: Aug. 14, 2017

(65) Prior Publication Data

US 2017/0345257 A1 Nov. 30, 2017

Related U.S. Application Data

(63) Continuation of application No. 14/995,433, filed on Jan. 14, 2016, now Pat. No. 9,734,666, which is a (Continued)

(51) Int. Cl.
*A63F 9/24* (2006.01)
*G07F 17/32* (2006.01)

(52) U.S. Cl.
CPC ..... *G07F 17/3244* (2013.01); *G07F 17/323* (2013.01); *G07F 17/326* (2013.01)

(58) Field of Classification Search
CPC ..... G07F 17/3244
See application file for complete search history.

(56) References Cited

U.S. PATENT DOCUMENTS 6,929,264 B2 8/2005 Huard et al.
7,548,242 B1 6/2009 Hughes et al.
(Continued)

FOREIGN PATENT DOCUMENTS

EP 1799318 3/2006
WO 2001078855 10/2001
(Continued)

OTHER PUBLICATIONS

"AU Application No. 2012202162 Examination Report", dated May 15, 2013, 4 pages.
(Continued)

*Primary Examiner* — Steve Rowland
(74) *Attorney, Agent, or Firm* — DeLizio Law, PLLC

(57) ABSTRACT

A gaming system and its operations include, for instance providing, for presentation via one or more electronic display devices associated with the gaming system, first digital content for a first application that is independent from a second application that concurrently presents second digital content via the one or more electronic display devices; intercepting, by the first application, data associated with the second digital content; determining, via one or more electronic processing units of the gaming system and based on the data, a relationship between the first digital content and the second digital content; and causing the second application to automatically modify presentation of the second digital content in response to determining the relationship.

20 Claims, 8 Drawing Sheets

Related U.S. Application Data continuation of application No. 13/449,246, filed on Apr. 17, 2012, now Pat. No. 9,257,006.

(60) Provisional application No. 61/476,629, filed on Apr. 18, 2011.

(56) References Cited

U.S. PATENT DOCUMENTS

| | | | |
|---|---|---|---|
| 7,618,317 | B2 | 11/2009 | Jackson |
| 7,719,424 | B2 | 5/2010 | Steil |
| 7,756,905 | B2 | 7/2010 | Shenfield et al. |
| 7,828,656 | B2 | 11/2010 | Paulsen et al. |
| 9,257,006 | B2 | 2/2016 | Gagner et al. |
| 9,734,666 | B2 | 8/2017 | Gagner et al. |
| 2001/0041612 | A1 | 11/2001 | Garahi et al. |
| 2002/0087592 | A1 | 7/2002 | Ghani |
| 2003/0064808 | A1 | 4/2003 | Hecht et al. |
| 2004/0053694 | A1 | 3/2004 | Rowe |
| 2004/0127284 | A1 | 7/2004 | Walker |
| 2004/0132532 | A1 | 7/2004 | Brosnan et al. |
| 2004/0185936 | A1 | 9/2004 | Block et al. |
| 2005/0032577 | A1 | 2/2005 | Blackburn et al. |
| 2005/0113172 | A1 | 5/2005 | Gong |
| 2006/0046817 | A1 | 3/2006 | Paulsen |
| 2007/0024002 | A1 | 2/2007 | McMain et al. |
| 2007/0054740 | A1 | 3/2007 | Salls et al. |
| 2007/0060363 | A1 | 3/2007 | Nguyen et al. |
| 2007/0213122 | A1 | 9/2007 | Okada |
| 2007/0243934 | A1 | 10/2007 | Little |
| 2007/0270212 | A1 | 11/2007 | Cockerille et al. |
| 2008/0076577 | A1 | 3/2008 | Brosnan et al. |
| 2008/0125219 | A1 | 5/2008 | Williams et al. |
| 2009/0069094 | A1 | 3/2009 | Brosnan et al. |
| 2009/0268754 | A1 | 10/2009 | Palm et al. |
| 2010/0093441 | A1 | 4/2010 | Rajaraman et al. |
| 2010/0255900 | A1 | 10/2010 | Ansari et al. |
| 2011/0028203 | A1 | 2/2011 | Agarwal et al. |
| 2011/0053672 | A1 | 3/2011 | Gagner et al. |
| 2011/0070951 | A1 | 3/2011 | Paulsen et al. |
| 2011/0250955 | A1 | 10/2011 | Adiraju et al. |
| 2012/0264504 | A1 | 10/2012 | Gagner et al. |
| 2014/0087810 | A1 | 3/2014 | Gagner et al. |
| 2016/0133091 | A1 | 5/2016 | Gagner et al. |

FOREIGN PATENT DOCUMENTS

| | | |
|---|---|---|
| WO | 2003023647 | 3/2003 |
| WO | 2004004280 | 1/2004 |
| WO | 2004024260 | 3/2004 |
| WO | 2005083562 | 9/2005 |
| WO | 2006026543 | 3/2006 |
| WO | 2006033986 | 3/2006 |
| WO | 2007030301 | 3/2007 |
| WO | 2007145954 | 12/2007 |
| WO | 2009018488 | 2/2009 |
| WO | 2009133432 | 11/2009 |

OTHER PUBLICATIONS

"AU Application No. 2012202162 Examination Report", dated May 21, 2014, 4 pages.

"U.S. Appl. No. 12/874,196 Final Office Action", dated May 24, 2013, 7 Pages.

"U.S. Appl. No. 12/874,196 Office Action", dated Aug. 10, 2012, 17 pages.

"U.S. Appl. No. 13/449,246 Final Office Action", dated Jan. 16, 2014, 14 Pages.

"U.S. Appl. No. 13/449,246 Office Action", dated Jan. 21, 2015, 5 Pages.

"U.S. Appl. No. 13/449,246 Office Action", dated Jul. 3, 2013, 16 Pages.

"U.S. Appl. No. 14/093,739 Office Action", dated Mar. 10, 2017, 18 pages.

"U.S. Appl. No. 14/995,433 Office Action", dated Sep. 28, 2016, 15 pages.

"U.S. Appl. No. 14/093,739 Final Office Action", dated Oct. 19, 2017, 16 pages.

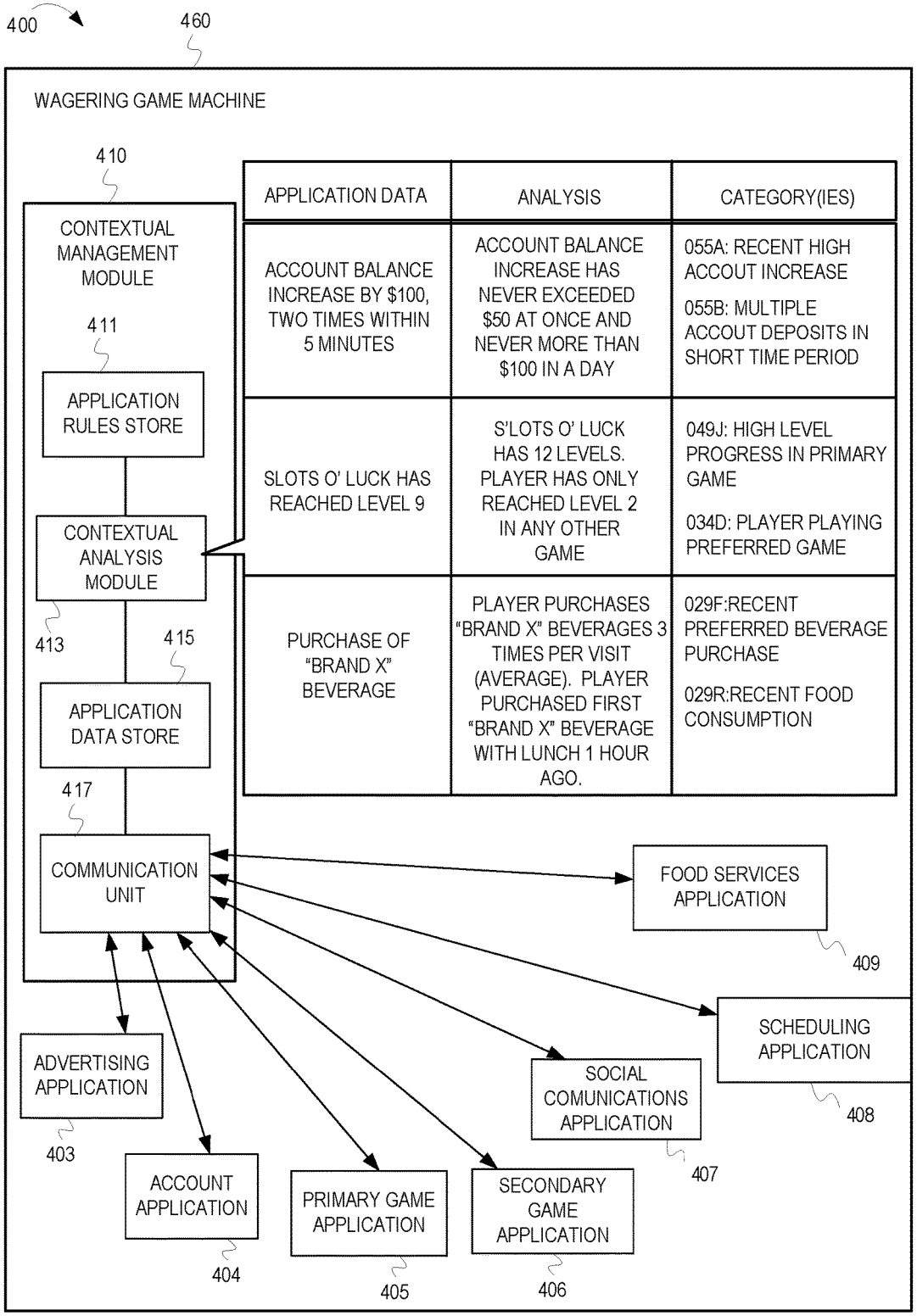

| APPLICATION DATA | ANALYSIS | CATEGORY(IES) |
|---|---|---|
| ACCOUNT BALANCE INCREASE BY $100, TWO TIMES WITHIN 5 MINUTES | ACCOUNT BALANCE INCREASE HAS NEVER EXCEEDED $50 AT ONCE AND NEVER MORE THAN $100 IN A DAY | 055A: RECENT HIGH ACCOUT INCREASE<br>055B: MULTIPLE ACCOUT DEPOSITS IN SHORT TIME PERIOD |
| SLOTS O' LUCK HAS REACHED LEVEL 9 | S'LOTS O' LUCK HAS 12 LEVELS. PLAYER HAS ONLY REACHED LEVEL 2 IN ANY OTHER GAME | 049J: HIGH LEVEL PROGRESS IN PRIMARY GAME<br>034D: PLAYER PLAYING PREFERRED GAME |
| PURCHASE OF "BRAND X" BEVERAGE | PLAYER PURCHASES "BRAND X" BEVERAGES 3 TIMES PER VISIT (AVERAGE). PLAYER PURCHASED FIRST "BRAND X" BEVERAGE WITH LUNCH 1 HOUR AGO. | 029F:RECENT PREFERRED BEVERAGE PURCHASE<br>029R:RECENT FOOD CONSUMPTION |

FIG. 4

DYNAMIC UPDATING OF CONTENT BASED ON GAMING-APPLICATION CONTEXT

RELATED APPLICATIONS

This application is a continuation of, and claims priority benefit of, U.S. application Ser. No. 14/995,433 filed Jan. 14, 2016, which is a continuation of, and claims priority benefit of, U.S. application Ser. No. 13/449,246 filed Apr. 17, 2012, which claims priority benefit of Provisional U.S. Application No. 61/476,629 filed Apr. 18, 2011. The Ser. No. 14/995,433 application, Ser. No. 13/449,246 application and the 61/476,629 application are each incorporated by reference herein in their respective entireties.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2017, Bally Gaming, Inc.

TECHNICAL FIELD

Embodiments of the inventive subject matter relate generally to wagering game systems and networks that, more particularly, manage contextual wagering game information.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play. However, wagering game providers and wagering game machine manufacturers run into challenges with controlling and presenting data on wagering game machines, servers, and other devices, as the features and enhancements of new wagering games becomes more complex. Some wagering game machines can run multiple applications simultaneously, which may simultaneously need to present information on the wagering game machine, thus increasing the control and presentation complexities that game programmers and machine designers must deal with. Thus there is a continuing need for wagering game providers, wagering game machine manufacturers, and others, to continuously develop new games and applications that will attract frequent game play but also interoperate with other hardware and software on wagering game systems and networks.

BRIEF DESCRIPTION OF THE DRAWING(S)

Embodiments are illustrated in the Figures of the accompanying drawings in which:

FIG. 4 is an illustration of centrally managing contextual updating of application content during a wagering game session, according to some embodiments;

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

Introduction

This section provides an introduction to some embodiments.

As mentioned previously, a wagering game machine can run various applications simultaneously to process wagering games, financial transactions, advertising, etc. Many of those applications concurrently generate information and events (e.g., content, messages, etc.) on the wagering game machine, but the applications are primarily unaware of each other's context. Some embodiments of the inventive subject matter, however, make applications that concurrently run on a wagering game machine aware of each other's context. Some embodiments analyze that context between applications, and, based on the analysis of the context, cause an automatic updating of application content (e.g., an update to presentation of content). Some embodiments can also cause the applications to generate new information based on the automatic, contextual, updating and broadcast that information to all concurrently running applications, making the applications aware of the updates.

Figure 1:
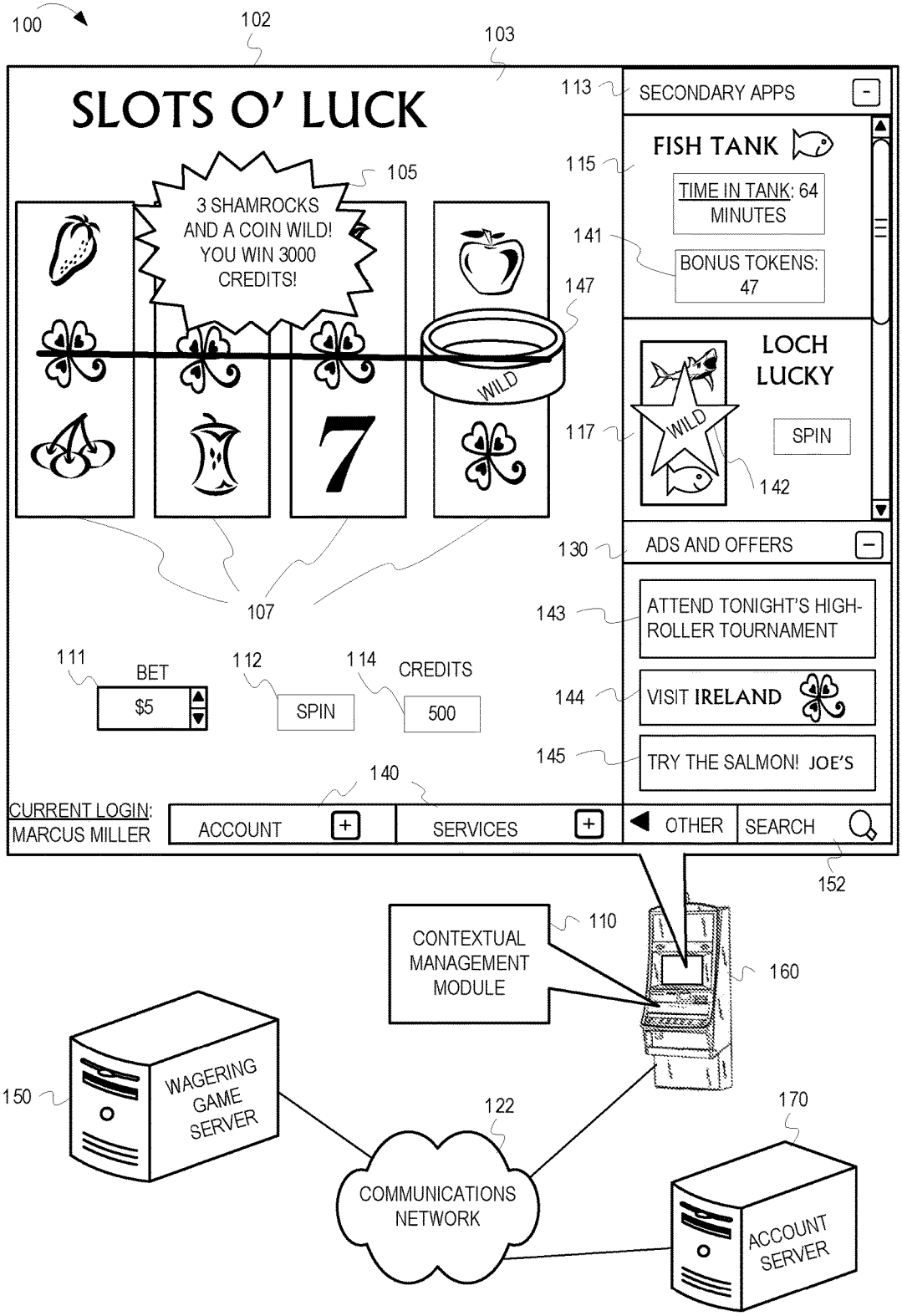
FIG. 1 is an illustration of dynamically updating content of applications during a wagering game session, according to some embodiments.

FIG. 1 is an illustration of dynamically updating content of applications during a wagering game session, according to some embodiments. In FIG. 1, a wagering game system ("system") 100 includes a wagering game machine 160 connected to a wagering game server 150 via a communications network 122. The wagering game machine 160 can store and present primary content, such as content of a primary wagering game application 103. The wagering game machine 160 can also store and present secondary content, such as secondary gaming applications 113 (e.g., a first secondary game application 115 and a second secondary game application 117), an advertising application 130, and other applications 140 (e.g., account information, casino services, etc.). The wagering game machine 160 presents the content via a display 102, via speakers, via emotive lighting, via peripheral devices, etc. In some embodiments, the wagering game server 150 can provide primary gaming content (e.g., server-based games), control for gaming content, secondary gaming content (e.g., server-side game applications), non-gaming content, or other content, information, services, etc. to the wagering game machine 160. The system 100 can further include an account server 170 that hosts a player account (e.g., an account that the user "Marcus Miller" uses to track wagering account information, player profile data, player history, etc.), and which becomes associated with the wagering game machine 160 during a wagering game session when a player (e.g., Marcus Miller) logs in to the wagering game machine 160.

The system 100 can further include a contextual management module 110. The contextual management module 110, in some embodiments, can be on, or associated with a component of, the wagering game machine 160. In other embodiments, however, the contextual management module 110 can be on, or is associated with, a component that is external to the wagering game machine 160.

The contextual management module 110 can communicate information about applications (e.g., events about content, status of content, game-related achievements, player settings, etc.), analyze the information, and respond to the information with updated information. In some embodiments, the contextual management module 110 can convert data, manage resource contention for resources (e.g., video, sound, etc.), control sound and light effect devices, share functionality and interpretation of player input, etc.

In some embodiments, the wagering game machine 160 can run multiple independent applications at the same time ("concurrently running applications"). The concurrently running independent applications can run independently from each other via separate processor threads or via different processors. The concurrently running applications can be related to game play as well as to non-game content that is utilized on a wagering game network. Examples of game play applications may include specifically configured wagering games, locally running primary wagering games (e.g., base games), bonus games, progressive games, community games, secondary wagering games, toolbar and widget games, independent gaming applications, side betting applications, etc. Examples of non-game applications may include casino player loyalty applications, casino services applications (e.g., drink ordering, ticket sales, etc.), player account management applications (e.g., player login, session management, financial transactions, etc.), advertising application, social networking and/or communications applications (e.g., player-to-player chat), maintenance applications, Internet applications, non-display related applications (i.e., applications that run and process content, but that do not display content via the display 102), etc.

The contextual management module 110 can coordinate and control communications between the concurrently running applications. For example, in some embodiments, the contextual management module 110 can receive events from secondary gaming applications 113 and from the primary wagering game application 103 (i.e., a fictional Irish themed slot game called "Slots O' Luck" having slot reels 107, a bet meter 111, a spin control 112, and a credit meter 114). In some embodiments, the contextual management module 110 can route and/or publish application data between the secondary gaming applications 113 and the primary wagering game application 103. In some embodiments, the secondary gaming applications 113 and the primary wagering game application 103 can pre-register with the contextual management module 110 to receive events from specific applications or to receive events that fit into pre-determined categories (e.g., data types, activity types, player types, etc.). The contextual management module 110 can aggregate (e.g., collect and store), data for types of events that the secondary gaming applications 113 and the primary wagering game application 103 are subscribed to. In some embodiments, the contextual management module 110 can analyze information associated with application data (e.g., analyze descriptive tags embedded in event data, analyze event metadata, analyze data associated with player accounts that initiate the events, analyze player history, analyze previous updates, etc.). In some embodiments, the contextual management module 110 can categorize data based on analysis. The contextual management module 110 can then provide information about the context of an application, or "contextual information" (e.g., analysis, categories, event data, etc.) to applications that request, require, or otherwise may be interested in the contextual information. The contextual management module 110 can also provide the contextual information to the wagering game server 150, the secondary content server 180, the account server 170, or any other data source or application, external to the wagering game machine 160, that may be interested in the contextual information. Further, in some embodiments, the contextual management module 110, or agents of the contextual management module 110, can convert, or re-format, application data into formats that are understood by, and can be used by, applications and data sources that are interested in the application data. In some embodiments, the contextual management module 110 can also coordinate the presentation of content (e.g., the location of windows, the presentation priority, etc.) on presentation devices (e.g., displays, speakers, etc.) associated with the wagering game machine 160.

In some embodiments, the contextual management module 110 can dynamically update any or all application content or structure (e.g., update structure of windows, update content presented in windows, etc.) in any of the applications running on the wagering game machine 160 based on the context of information provided by any of the other applications, such as by the primary wagering game application 103. For example, the contextual management module 110 can cause secondary applications to dynamically update their content based on the context of the information from the primary wagering game application 103. For instance, the contextual management module 110 can detect information about the primary wagering game application 103 and affect content presented in an advertising application 130. For example, the contextual management module 110 detects the theme of the primary wagering game application 103, the theme of the first secondary game application 115, and the theme of the second secondary game application 117, and categorizes the player as an individual who enjoys Irish themes and/or fishing themes. The contextual management module 110 can then provide information to all other applications, which can provide advertisements related to the themes (e.g., a vacation or show related to Ireland, as in the advertisements 144, an advertisement related to fish, as in the advertisement 145, etc.). In some embodiments, the contextual management module 110 determines that a large amount of money was won in the primary wagering game application 103 (e.g., indicated in the celebratory message 105), detects an increase to a high denomination level, detects a large deposit to an account balance, or some other indication of an increase in money value or risk value. The contextual management module 110 can analyze the increase in money value or risk and categorize the player as a high-roller. Based on the categorization as a high-roller, the advertising application 103 dynamically adjusts its advertisements to advertise accountants, upscale products, high-end merchandise, high-roller services and offers (e.g., presents an invitational offer 143 to a high-roller tournament), etc.

In some embodiments, the contextual management module 110 can cause the primary wagering game application 103 to dynamically update its content based on the context of the information from secondary applications. For example the contextual management module 110 can determine that a player enters a search query for casino information via a search application 152. The contextual management module 110 can then cause the primary wagering game application 103 to modify themes, graphical appearance of reel elements, etc. to be similar to, or related to, the search query. In some embodiments, the contextual management module 110 can detect functionality of a secondary game, such as an expanding wild element 142 of the second secondary game application 117 and transfer the functionality, or an interpretation of the functionality, to the primary wagering game application 103. For example, the primary wagering game application 103 can receive information about the expanding wild element 142 and apply the feature to the wild element 147 of the primary wagering game application 103.

In some embodiments the contextual management module 110 can cause secondary applications to dynamically update based on the context of information from other secondary applications. For example, the system can detect that the first secondary game application 115 utilizes secondary economy trading units (e.g., bonus tokens 141) that only certain other secondary games accept or award. As a result, the contextual management module 110 can suggest other games that use or award the bonus tokens 141 or the contextual management module 110 may emphasize the capabilities of other applications to utilize or award bonus tokens. In some embodiments, the contextual management module 110 may offer to award bonus tokens in other games instead of, or in addition to, money or other awards. In some embodiments, contextual management module 110 can detect context of social networking applications on the wagering game machine 160, or elsewhere on the network, that integrates with the player account. For instance, the player (e.g., Marcus Miller) has a player account that lists social contacts, such as friends, family, etc. A social networking application may run on the wagering game machine 160 that tracks activities by the social contacts. For instance, the social networking application tracks that the player's spouse makes dinner reservations at "Joe's" restaurant. The advertising application 103, therefore, adapts its advertising, such as to show the advertisement 145 for specific menu items at Joe's restaurant. In another example, the contextual management module 110, can suggest or create a community bonus game based on what other players have purchased or done via other applications. For example, if a group of players have purchased specific show tickets, then the primary wagering game application 103 or secondary game applications 113 can offer a bonus game that has a theme that follows special elements or themes of the show.

Further, some embodiments of the inventive subject matter describe examples of managing contextual wagering game information in a network wagering venue (e.g., an online casino, a wagering game website, a wagering network, etc.) using a communication network, such as the communications network 122 in FIG. 1. Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, in some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
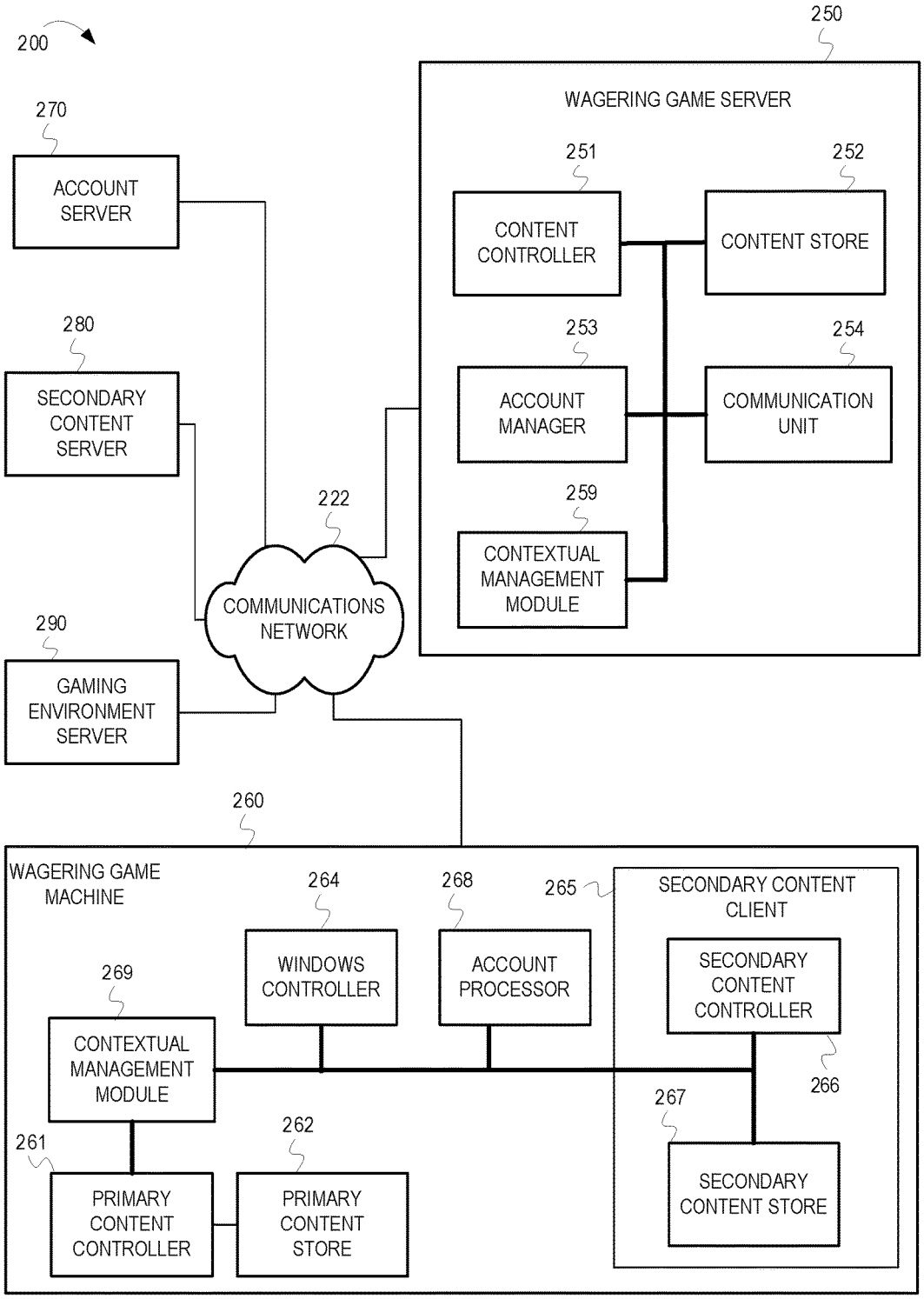
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networking networks. The account server 270 can store wagering game player account information, such as account settings (e.g., settings related to group games, settings related to social contacts, etc.), preferences (e.g., player preferences regarding audio, player preferences regarding text, player preferences regarding game themes, player preferences regarding award types, preferences related to virtual assets, etc.), player profile data (e.g., name, avatar, screen name, etc.), and other information for a player's account (e.g., financial information, account identification numbers, virtual assets, social contact information, etc.). The account server 270 can contain lists of social contacts referenced by a player account. The account server 270 can also provide auditing capabilities, according to regulatory rules. The account server 270 can also track performance of players, machines, and servers.

The wagering game system architecture 200 can also include a wagering game server 250 configured to control wagering game content, provide random numbers, and communicate wagering game information, account information, and other information to and from a wagering game machine 260. The wagering game server 250 can include a content controller 251 configured to manage and control content for the presentation of content on the wagering game machine 260. For example, the content controller 251 can generate game results (e.g., win/loss values), including win amounts, for games played on the wagering game machine 260. The content controller 251 can communicate the game results to the wagering game machine 260. The content controller 251 can also generate random numbers and provide them to the wagering game machine 260 so that the wagering game machine 260 can generate game results. The wagering game server 250 can also include a content store 252 configured to contain content to present on the wagering game machine 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the wagering game machine 260 and to communicate with other systems, devices and networks. The wagering game server 250 can also include a contextual management module 259 configured, in some embodiments, to detect application data for concurrently running applications, analyze context of the application data and/or determine relationships between application content, and dynamically modify content from the concurrently running applications.

The wagering game system architecture 200 can also include a secondary content server 280 configured to provide content and control information for secondary games and other secondary content available on a wagering game network (e.g., secondary wagering game content, promotions content, advertising content, player tracking content, web content, etc.). The secondary content server 280 can provide "secondary" content, or content for "secondary" games presented on the wagering game machine 260. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the secondary content can be in one or more different formats, such as Adobe® Flash®, Microsoft® Silverlight™, Adobe® Air™, hyper-text markup language, etc. In some embodiments, the secondary content server 280 can provide and control content for community games, including networked games, social games, competitive games, or any other game that multiple players can participate in at the same time. In some embodiments, the secondary content server 280 can control and present an online website that hosts wagering games. The secondary content server 280 can also be configured to present multiple wagering game applications on the wagering game machine 260 via a wagering game website, or other gaming-type venue accessible via the Internet. The secondary content server 280 can host an online wagering website and/or a social networking website. The secondary content server 280 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The secondary content server 280 can also be configured to, in some embodiments, dynamically modify content for concurrently running applications. In some embodiments, the secondary content server 280 can also host social networking accounts, provide social networking content, control social networking communications, store associated social contacts, etc. The secondary content server 280 can also provide chat functionality for a social networking website, a chat application, or any other social networking communications mechanism. In some embodiments, the secondary content server 280 can utilize player data to determine marketing promotions that may be of interest to a player account. The secondary content server 280 can also analyze player data and generate analytics for players, group players into demographics, integrate with third party marketing services and devices, etc. The secondary content server 280 can also provide player data to third parties that can use the player data for marketing. In some embodiments, the secondary content server 280 can provide one or more social networking communication mechanisms that publish (e.g., post, broadcast, etc.) a message to a mass (e.g., to multiple people, users, social contacts, accounts, etc.). The social networking communication mechanism can publish the message to the mass simultaneously. Examples of the published message may include, but not be limited to, a blog post, a mass message post, a news feed post, a profile status update, a mass chat feed, a mass text message broadcast, a video blog, a forum post, etc. Multiple users and/or accounts can access the published message and/or receive automated notifications of the published message.

The wagering game system architecture 200 can also include a gaming environment server 290 configured to present environmental light and sound effects in a casino environment. The gaming environment server 290 is further configured to provide content data, user data, and control information regarding gaming effects within a casino environment. For example, the gaming environment server 290 can coordinate a synchronized presentation of lighting and sound effects across a bank of wagering game machines and/or other lighting and sound producing devices within one or more areas of a casino. The gaming environment server 290 can also be configured to detect gaming events, such as events generated by the wagering game server 250 and/or the wagering game machine 260. The gaming environment server 290 can generate data for a synchronized light/sound show based on the gaming events. The gaming environment server 290 can control environmental light presentation devices within a casino. The gaming environment server 290 can provide emotive lighting presentation data, including light presentation commands on emotive lighting devices on or near wagering game machines, as well as other devices within the casino such as spotlights, overhead emotive lighting, projectors, etc. The gaming environment server 290 can be configured to determine multi-media, casino-content, including casino-wide special effects that include sound effects and light effects. The multi-media casino content can be presentable across a plurality of casino content presentation devices ("presentation devices") in a casino. The multi-media, casino-content effect can be related to a wagering game presentation or event. The wagering game presentation or event can be tied to the functionality, activity, or purpose of a wagering game. For instance, wagering game presentations can be related to attracting wagering game players to groups of wagering game machines, presenting game related outcomes across multiple wagering game machines, expressing group gaming activity across multiple wagering game machines, focusing attention on a particular person or machine in response to a gaming event, etc. The presentation devices present sound and light effects that accompany a gaming event (e.g., a jackpot celebratory effect that focuses on a wagering game machine, a lightning strike that introduces a community gaming event, and a musical chair game that reveals a community wagering game winner). The gaming environment server 290 can also be configured to determine timing control data for the multi-media effect. In some embodiments, timing control data can be stored on the gaming environment server 290, or be accessible to the gaming environment server 290 via another device (e.g., a lighting controller associated with a bank of wagering game machines), to use to send lighting commands in sequential order to network addresses of presentation device on a casino network. The gaming environment server 290 can determine channels assigned with casino-content presentation devices, such as the wagering game machine 260. In some embodiments, the presentation devices can have an addresses assigned to a channel. For example, the wagering game machine 260 could be on one channel, peripheral devices could be on another channel, network light presentation devices can be on other channels, etc. In some embodiments, the gaming environment server 290 can be a DMX controller connected in parallel to an emotive lighting controller on, or associated with, the wagering game machine 260. The DMX controller can also be connected in parallel to a plurality of other presentation devices (e.g., other wagering game machines, lighting presentation devices, etc.) within a casino, and can simultaneously provide DMX lighting commands to the wagering game machine 260 and to the other presentation devices. DMX can change light intensity, or other light characteristics, over time. Some embodiments of DMX controllers can update commands very quickly (e.g., 30-47 times a second) across multiple channels (e.g., 512 channels). A DMX controller can put different commands in every channel (e.g., one channel can have show "X," one channel can have show "Y," etc.). The DMX can also have a frame number within a show. Some devices can take up more than one channel (e.g., an emotive light might have three colors and may take up a channel for each color, a spotlight might have seven channels, etc.). Each device can receive 512 bytes of data from the DMX controller at any given time interval (e.g., frame). The 512 bytes of data can be divided in different ways. For example, 6 bytes may address light effect behavior, 6 bytes may include show numbers, 6 bytes may include frame numbers, 1 byte may include priority values, and so on for various light effect characteristics (e.g., intensity, color, pan, tilt, etc.). The presentation device that receives the DMX command data is programmed to interpret the lighting data in the channel. In some embodiments, the presentation devices can be DMX compliant including having a DMX input port to accept DMX commands. In some embodiments, presentation devices can convert the DMX commands to proprietary commands. In addition to the DMX protocol, other types of dedicated lighting protocols can include AMX 192, CMX, SMX, PMX, protocols included in the EIA-485 standard, etc.

The wagering game system architecture 200 can also include the wagering game machine 260 configured to present wagering games and receive and transmit information to manage multiple wagering game applications. The wagering game machine 260 can include a primary content controller 261 configured to manage and control the presentation of primary content on the wagering game machine 260. The wagering game machine 260 can also include a primary content store 262 configured to contain primary content to present on the wagering game machine 260. The wagering game machine 260 can also include a contextual management module 269 configured, in some embodiments, to detect application data for concurrently running applications, analyze context of the application data and/or determine relationships between application content, and dynamically modify content from the concurrently running applications. The contextual management module 269 can further be configured to manage (e.g., aggregate, publish, route, convert, etc.) communication and interpretation of events between applications, services, components, etc. of the wagering game machine 260 and other devices associated with and/or external to the wagering game machine 260. The contextual management module 269 can further manage multiple instances of gaming applications. For example, the contextual management module 269 can be configured to launch, load, unload and control applications and instances of applications. The contextual management module 269 can launch different software players (e.g., a Microsoft® Silverlight™ player, an Adobe® Flash® player, etc.) and manage, coordinate, and prioritize what the software players do. The contextual management module 269 can also coordinate instances of server applications in addition to local copies of applications. The contextual management module 269 can control window locations on a wagering game screen or display for the multiple gaming applications. In some embodiments, the contextual management module 269 can manage window locations on multiple displays including displays on devices associated with and/or external to the wagering game machine 260 (e.g., a top display and a bottom display on the wagering game machine 260, a peripheral device connected to the wagering game machine 260, a mobile device connected to the wagering game machine 260, etc.). The contextual management module 269 can manage priority or precedence of client applications that compete for the same display area. For instance, the contextual management module 269 can determine each client application's precedence. The precedence may be static (i.e. set only when the client application first launches or connects) or dynamic. The applications may provide precedence values to the contextual management module 269, which the contextual management module 269 can use to establish order and priority. The precedence, or priority, values can be related to tilt events, administrative events, primary game events (e.g., hierarchical, levels, etc.), secondary game events, local bonus game events, advertising events, etc. As each client application runs, it can also inform the contextual management module 269 of its current presentation state. The applications may provide presentation state values to the contextual management module 269, which the contextual management module 269 can use to evaluate and assess priority. Examples of presentation states may include celebration states (e.g., indicates that client application is currently running a win celebration), playing states (e.g., indicates that the client application is currently playing), game starting states (e.g., indicates that the client application is showing an invitation or indication that a game is about to start), status update states (e.g., indicates that the client application is not 'playing' but has a change of status that should be annunciated, such as a change in progressive meter values or a change in a bonus game multiplier), idle states (e.g., indicates that the client application is idle), etc. In some embodiments, the contextual management module 269 can be pre-configurable. The system can provide controls and interfaces for operators to control screen layouts and other presentation features for the configuring the contextual management module 269. The contextual management module 269 can communicate with, and/or be a communication mechanism for, a base game stored on a wagering game machine. For example, the contextual management module 269 can communicate events from the base game such as the base game state, pay line status, bet amount status, etc. The contextual management module 269 can also provide events that assist and/or restrict the base game, such as providing bet amounts from secondary gaming applications, inhibiting play based on gaming event priority, etc. The contextual management module 269 can also communicate some (or all) financial information between the base game and other applications including amounts wagered, amounts won, base game outcomes, etc. The contextual management module 269 can also communicate pay table information such as possible outcomes, bonus frequency, etc.

In some embodiments, the contextual management module 269 can control different types of applications. For example, the contextual management module 269 can perform rendering operations for presenting applications of varying platforms, formats, environments, programming languages, etc. For example, the contextual management module 269 can be written in one programming language format (e.g., JavaScript, Java, C++, etc.) but can manage, and communicate data from, applications that are written in other programming languages or that communicate in different data formats (e.g., Adobe® Flash®, Microsoft® Silverlight™, Adobe® Air™, hyper-text markup language, etc.). The contextual management module 269 can include a portable virtual machine capable of generating and executing code for the varying platforms, formats, environments, programming languages, etc. The contextual management module 269 can enable many-to-many messaging distribution and can enable the multiple applications to communicate with each other in a cross-manufacturer environment at the client application level. For example, multiple gaming applications on a wagering game machine may need to coordinate many different types of gaming and casino services events (e.g., financial or account access to run spins on the base game and/or run side bets, transacting drink orders, tracking player history and player loyalty points, etc.).

The wagering game machine 260 can also include a windows controller 264 configured to work in conjunction with the contextual management module 269 to perform instructions received by, and or generate instructions on behalf of, the contextual management module 269, that manipulate and control windows, or other user interfaces, presented on the wagering game machine 260. The wagering game machine 260 can also include an account processor 268 configured to control and communicate account information (e.g., financial transactions, player tracking information, etc.). The wagering game machine 260 can also include at least one secondary content client 265 configured to present secondary content applications (e.g., client player instances). The secondary content client 265 can receive event data from, and provide event data to, the contextual management module 269. The secondary content client 265 can include a secondary content controller 266 and a secondary content store 267. The secondary content controller 266 can be configured to manage and control the presentation of secondary content on the wagering game machine 260, which secondary content is specific to the secondary content client 265. The secondary content store 267 can be configured to store secondary content on the wagering game machine 260.

Each component shown in the wagering game system architecture 200 is shown as a separate and distinct element connected via a communications network 222. However, some functions performed by one component could be performed by other components. For example, the wagering game server 250 can also be configured to perform functions of the secondary content server 280, the gaming environment server 290, and other network elements and/or system devices. Furthermore, the components shown may all be contained in one device, but some, or all, may be included in, or performed by, multiple devices, as in the configurations shown in FIG. 2 or other configurations not shown. For example, the account manager 253 and the communication unit 254 can be included in the wagering game machine 260 instead of, or in addition to, being a part of the wagering game server 250. Further, in some embodiments, the wagering game machine 260 can determine wagering game outcomes, generate random numbers, etc. instead of, or in addition to, the wagering game server 250.

The wagering game machines described herein (e.g., wagering game machine 260) can take any suitable form, such as floor standing models, handheld mobile units, bartop models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
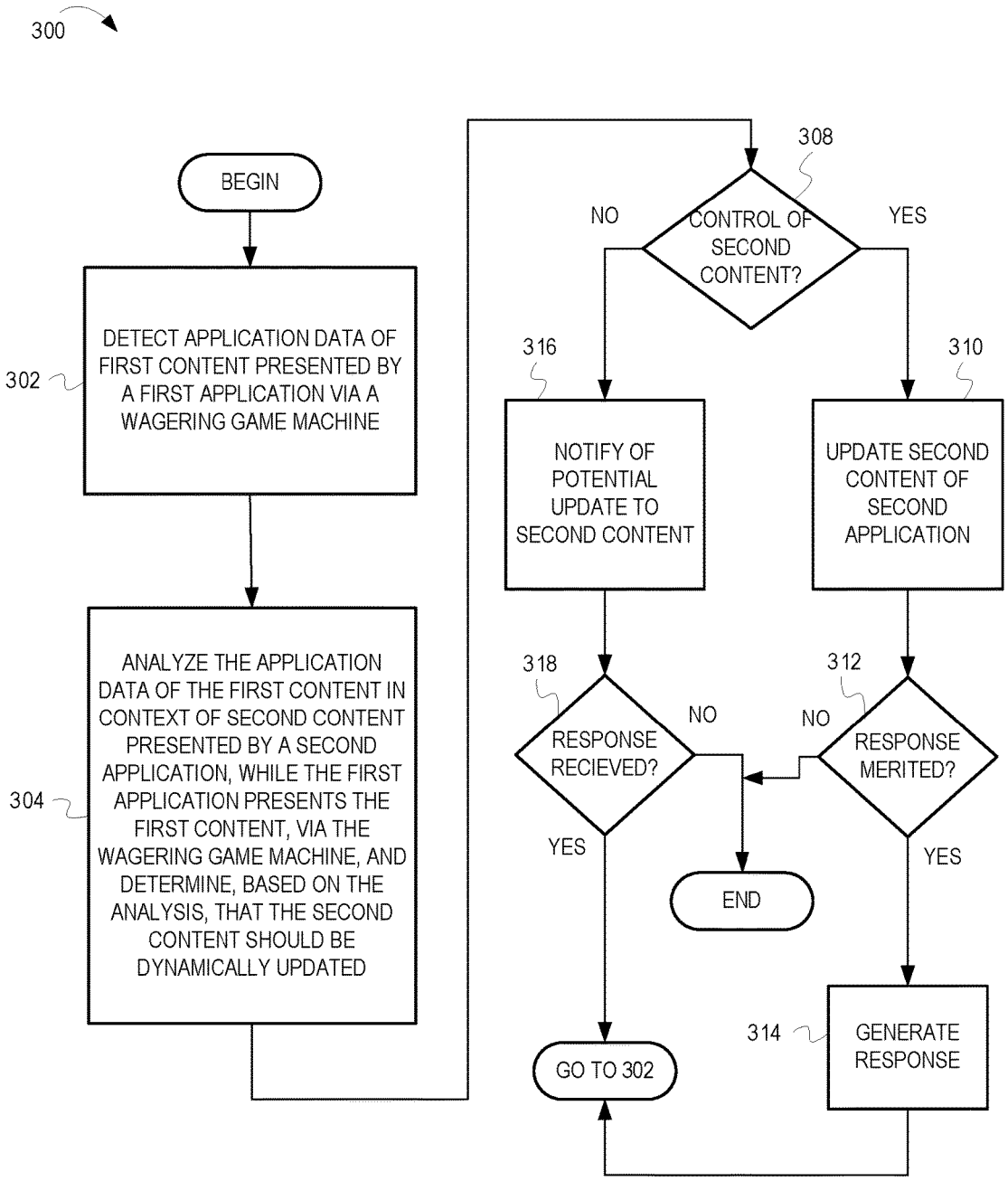
FIG. 3 is a flow diagram 300 illustrating dynamically updating content of applications during a wagering game session, according to some embodiments.
Figure 5:
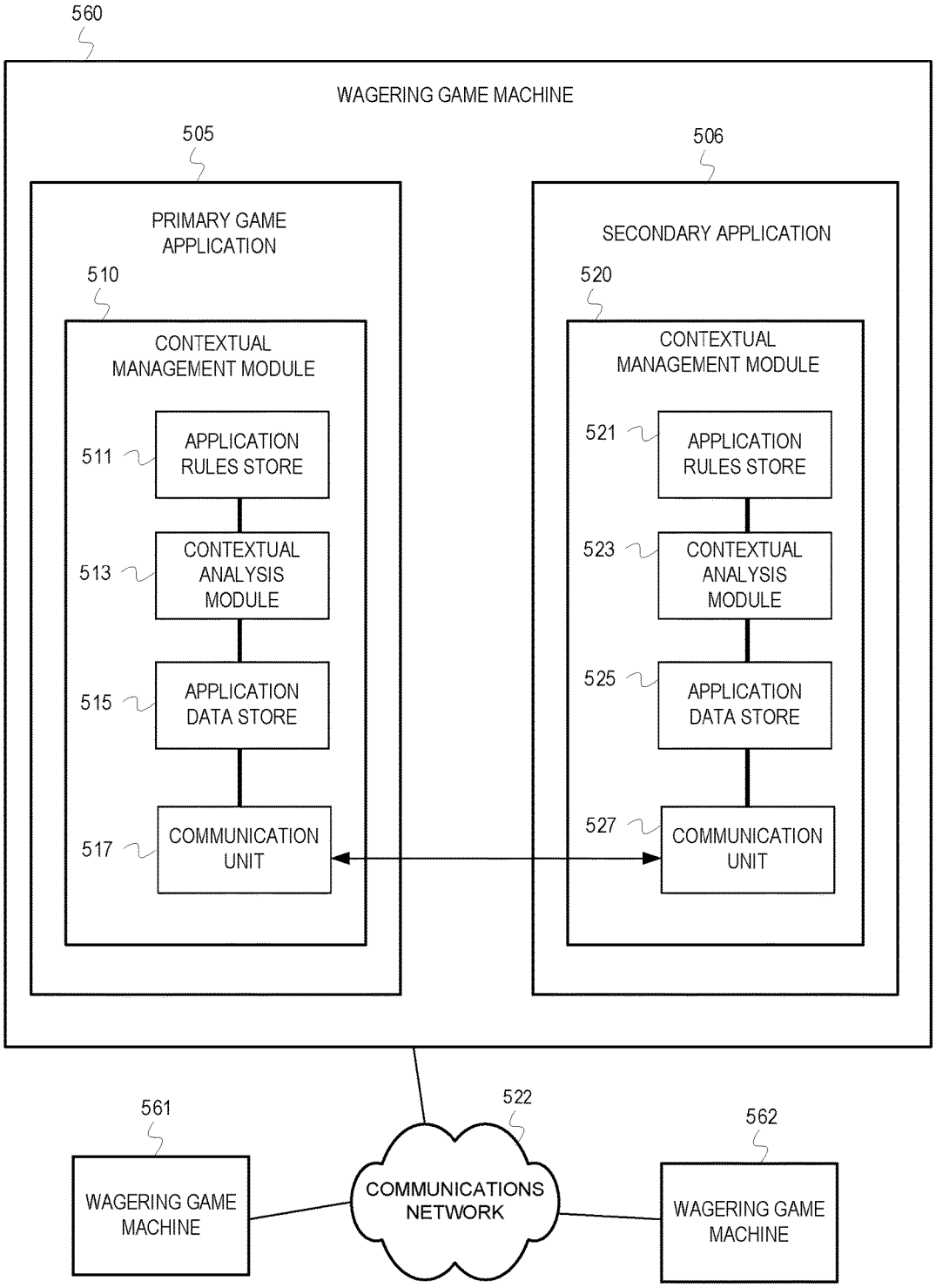
FIG. 5 is an illustration of peer-to-peer managing of contextual updating of application content during a wagering game session, according to some embodiments.

FIG. 3 is a flow diagram ("flow") 300 illustrating dynamically updating content of applications during a wagering game session. FIGS. 4 and 5 are conceptual diagrams that help illustrate the flow of FIG. 3, according to some embodiments. This description will present FIG. 3 in concert with FIGS. 4 and 5. In FIG. 3, the flow 300 begins at processing block 302, where a wagering game system ("system") detects application data of first content, presented by a first application, via a wagering game machine. The first application may broadcast the first application data. Other applications may subscribe to the application data. The application data may include characteristics, properties, player input, metatag data, event data, state data, or any other information related to the first application. For example, in FIG. 4, a wagering game system ("system") 400 includes a wagering game machine 460 that concurrently presents content via applications 403-409 (e.g., advertising application 403, account application 404, primary game application 405, secondary game application 406, social communications application 407, scheduling application 408, and food services application 409). The applications 403-409 can be software designed for use on the wagering game machine 460 and may be run by the wagering game machine 460, a server, a combination, other devices (e.g. a processor associated with a player's mobile device), etc. The wagering game machine 460, server, etc., can receive the applications 403-409 from various application providers via a communications network (e.g., via a network download) and/or via other means (e.g., direct installation from disk). The wagering game machine 460 presents content via the applications 403-409 as requested or needed. As the applications 403-409 present content, the applications 403-409 provide application data (e.g., publish the application data) to a communication unit 417 of a contextual management module 410. Application data can include states (application states, state of game play, instructions in queue, etc.), events (game outcomes, wager amounts, how much a machine/player has won, game play element configurations, game results, awards, bonus rounds, game history, etc.), properties, (e.g., window positions, level of communications, etc.), and other information (e.g., player data, metadata, account information, etc.).

The flow 300 continues at processing block 304, where the system analyzes the application data of the first content in context of second content, presented by a second application while the first application presents the first content, via the wagering game machine, and determines, based on the analysis, that the second content should be dynamically updated. In some embodiments, the second application analyzes the application data and determines that the second content should be dynamically updated. In other embodiments, other applications, or controllers, on, in, or associated with, the first and second applications and/or the wagering game machine, analyze the application data and determine whether the second content should be dynamically updated. The system can determine a relationship between a characteristic of the application data and a characteristic of the second content (e.g., a relationship between an event description and a rule associated with the event description, a relationship between rules and characteristics, a relationship between a common type of property, setting, value, etc. associated with the first content and a similar type of property, setting, value, etc. of the second content, a relationship between metadata, a relationship between history, a relationship between categories, a relationship between rules, etc.). The system can decide, based on the analysis and/or relationship (e.g., the relationship discovered via the analysis) to dynamically update the second content of the second application. Dynamically updating content may include, but is not limited to, dynamically changing content, dynamically moving or resizing content or structures, dynamically adding content, removing content, hiding content, activating content or features, pushing content, pulling content, publishing content, subscribing to content, broadcasting content, converting content, interpreting content, reformatting content, changing settings related to content, modifying characteristics or properties of content, communicating messages, sharing graphics, etc. In some embodiments, the system can determine, based on the analysis of the application data of the first content, that a third application replaces the second application (e.g., to present third content, to take over control of the second content, etc.).

The flow 300 continues at processing block 308, where the system determines whether it has control of the second content. If the system has control of the second content, then, at processing block 310 the system updates the second content. The system can use a rule (e.g. instructions associated with a rule), to make dynamic updates. For example, the system can activate a computer instruction associated with the rule. The computer instruction can alter the second content. In FIG. 4, the contextual management module 410 may have control over the applications 403-409, and can dynamically update content associated with the applications 403-409.

Referring again to FIG. 3, at processing block 312, the system determines whether other applications (e.g., the first application) should be informed of the update to the second content. If the update to the second content merits broadcasting to other applications, then the flow 300 continues at processing block 314 where the system generates and broadcasts additional application data regarding the second content of the second application. In some embodiments, the system can automatically generate and broadcast additional application data of the second content without determining whether it is merited. If the system generates and broadcasts the additional application data of the second content, the flow 300 can then return to processing block 302 and can repeat the flow 300 using the additional application data of the second content instead of the application data of the first content.

If, however, at processing block 308, the system does not have control of the second content, then the process continues at block 316, where the system notifies a controller of the second content of a potential update to the second content based on the analysis of the context of the application data of the first content. For instance, In FIG. 4, the contextual management module 410 may be a centralized coordinator (e.g. a centralized application) and may not have control of the applications 403-409. Thus, the contextual management module 410 can send the application data, analysis data, category data, etc. to controllers associated with the applications 403-409 to utilize themselves. For example, in FIG. 5, applications can communicate with each other instead of, or in addition to, via a centralized coordinator. For example, a wagering game machine 560 includes multiple contextual management modules 510 and 520 that are separately associated with separate applications (e.g., with a primary game application 505 and a secondary application 506). Each of the contextual management modules 510 and 520 have application rules stores 511 and 521, contextual analysis modules 513 and 523, application data stores 515 and 525, and communication units 517 and 527. The primary game application 505 and the secondary application 506 can intercept messages from each other (e.g., via the communication units 517, 527), which can trigger new messages, data, events, states, property changes, etc. The application rules stores 511 and 521 can contain individual rule sets and/or rule controllers that controls how to handle application data under known and foreseeable scenarios or combinations of events, states, etc. that are specifically related to the respective ones of the primary game application 505 or the secondary application 506.

Returning to FIG. 3, at processing block 318, if the system does not have control over the second content, the system can determine whether a response is provided by the second application, or any other application that received the notification, regarding the potential update to the second content provided at processing block 316. If the system receives a response, as described at processing block 318, then the flow 300 can return to processing block 302 and can repeat the flow 300 using additional application data of the second content instead of the application data of the first content.

Now, referring back to FIG. 4, a contextual analysis module 413 (or in other embodiments, the contextual analysis modules 513 and 523 of FIG. 5) can analyze rules stored in an application rules store 411. The application rules store 411 includes rules that pertain to the applications 403-409 specifically, such as specific elements or configurations of the specific applications 403-409. The contextual analysis module 413 can analyze the application data for the first content, in relation to a current state for the second content, using rules in the application rules store 411 that pertain to either the first application or the second application. The contextual analysis module 413 can then make a decision and/or create additional data that the applications can utilize to make their own decisions. For example, the contextual analysis module 413 can generate categories based on the analysis of the application data of the first content. The system can distribute the decision to the applications 403-409 to dynamically update their own content or the contextual management module 410 can cause the applications 403-409 to update their content dynamically. The decisions can be instructions, programs, etc. associated with a particular rule that relates the first content to the second content, via a characteristic of the application data.

For example, the contextual analysis module 413 detects an event regarding a transaction of a large money amount, such as a large bet, or a large win, a large deposit, etc., that affects a player account balance. For instance, the contextual analysis module 413 detects that a player increases an account balance by $100, or 100 credits, using the account application 404, which tracks player account information. The contextual analysis module 413 can analyze player account history to determine whether the player has ever used the account application 404 to increase the player account balance by $100. In doing so, for instance, the contextual analysis module 413 may determine that the player has never increased the player account balance by more than $50 in a day. As a result, the contextual analysis module 413 categorizes the increase to the player account balance as a recent high account increase for that player account (e.g. assigns an example category of "055A"). The contextual analysis module 413, however, continues to analyze the timing of the increase to the player account balance against a history of player account transactions, via the account application 404, and determines that the player has, within the last 5 minutes, made another high deposit amount of $100. The contextual analysis module 413, therefore, assigns a second category that indicates multiple account deposits in a short time period (e.g. assigned the example category of "055B"). In one example, based on the analysis, and the assigned categories, the contextual analysis module 413 can determine that the advertising application 403 should dynamically respond by showing high-end advertising, or that the secondary game application 406 should suggest a denomination increase. In another example, the contextual analysis module 413 can determine that the multiple increases in a short period of time may indicate a lack of judgment. For example, the contextual analysis module 413 may interface with the player account and determine whether the player has been flagged as being an irresponsible gamer, or whether there are settings set by the player, a spouse, or other individual, that should give a warning when irresponsible gaming type of activity occurs. As a result, the contextual analysis module 413 may communicate with a spouse via the social communications application 407 or open a chat screen to another wagering game machine that the spouse may be seated at. The contextual analysis module 413 may suggest alternative activities via the advertising application 403, such as a show, or even may suggest, via the secondary game application 406, lowering denomination values. Thus, the contextual analysis module 413 can perform progressive analysis of current and previous decisions and reevaluate previous decisions. For example, depending on the player's history, the system can dynamically make updates given events as they occur (e.g., the first $100 deposit resulted in a decision to suggest higher denomination values, but the second $100 deposit within the short time period, when reevaluated, suggests using lower denomination values).

In another example, the contextual analysis module 413 can analyze a player's history of performance in a game (e.g., if the player has increased in levels to a higher level). For example, the contextual analysis module 413 can determine that the primary game application 405 has attained a new level. The contextual analysis module 413 can analyze the new level attainment with player history data on the account application 404 and/or the secondary game application 406, to determine whether the new level is a high level and whether the player has attained such a high level in any other games. For instance, the contextual analysis module 413 determines that the level is level "9" of "12" levels, which indicates a high level achievement, and can assign a corresponding category (e.g., example category "049J"). The contextual analysis module 413 can also determine that the player has not reached higher than a level "2" in any other game. The contextual analysis module 413, thus, can assign a category (e.g., "034D") that indicates that the player is playing a preferred game. The advertising application 403 could also offer rewards or advertisements of a specific nature when a player reaches a high level, or is playing a game in a high level, and, thus the contextual analysis module 413 can communicate the category codes to the advertising application 403 to utilize. For example, the contextual analysis module 413, or the advertising application 403, can compare the category codes to metatags in advertising content, and select from matching advertising content.

In some embodiments, the contextual analysis module 413 can analyze a player's activity outside of a game. For example, the contextual analysis module 413 can detect, via the food services application 409, that a player has purchased a "brand X" beverage. The contextual analysis module 413 analyzes against player purchase history and recent activity from the scheduling application 408 that indicates that the player typically purchases "brand X" beverage 3 times per casino visit and, based on the player's schedule data from the scheduling application 408, that the player recently ate lunch. During the lunch, the player purchased the first "brand X" beverage. The contextual analysis module 413, thus, assigns categories (e.g., "029F" and "029R") that indicate a recent preferred beverage purchase and recent food consumption. The advertising application 403 can, therefore, refrain from advertising beverages for a specific amount of time, or advertise a different type of beverage (e.g. brand "Y" beverage).

In another example, the contextual analysis module 413 analyzes third-party communications from third party applications. For example, the social communications application 407 may be an application that is provided by, or integrated with, a social networking company or website (e.g., Twitter, Facebook™, etc.). The contextual analysis module 413 can analyze Twitter tweets, Facebook™ posts, etc., and integrate social communications and graphics from social contacts into the primary game application 405 and the secondary game application 406, schedule group games with social contacts within a casino or via the social communications application 407, suggest games (e.g., social networking games), etc.

In another example, the contextual analysis module 413 analyzes login history. For example, the account application 404, or an associated login application, broadcasts that two individuals have logged in at a same bank of wagering game machines. The social communications application 407 can offer to connect the two as friends. The social communications application 407 can also provide group information about all players at a bank, the contextual analysis module 413 can dynamically modify content in some applications. For example, if a player at a neighboring wagering game machine is viewing, or listening to, an advertisement, then the advertising application 403 may refrain from showing that specific advertisement.

The system 400 can also be configured to dynamically generate new rules and/or reconfigure itself to adapt to new rules. For instance, the system 400 can recognize new scenarios of previously unknown events and come up with new rules for handling the new scenario. The system 400 can dynamically add the new rules to the application rules store 411 and/or to individual rules stores for each application. If the scenarios are potentially repeatable by other wagering game machines, the system 400 can provide an application configuration server with the new rules for those scenarios. The application configuration server can configure the applications 403-409 for the new rules. The application configuration server can further push updated rules to the wagering game machine 460 and other wagering game machines via a communications network. The system 400 can also provide the new scenarios to application providers so that the application providers can update the software to respond to the new scenarios with new rules/functionalities and other related scenarios. The applications 403-409 may be referred to herein as "smart", "dynamic", "reactive", etc. to emphasize the ability for an example application to provide application data, react to application data from other applications, dynamically update its own content, etc. Further, although FIG. 4 illustrates the application rules store 411, the contextual analysis module 413, the application data store 415, the communication unit 417, and the applications 403-409 on the wagering game machine 460, any of those components can be on other devices, such as one or more servers. The server(s) can track the application data from the applications 403-409 on the wagering game machine 460, and/or on other wagering game machines connected to a communications network, analyze, categorize, dynamically update, etc. In other embodiments, the server(s) can also have applications that provide application data for the wagering game machine 460 to use and/or to interact with application data generated by the applications 403-409. The contextual management module 410, and/or the applications 403-409, can also receive application data from other applications (e.g., network applications, applications on personal computing devices or mobile devices connected to the communications network, etc.) and/or devices (e.g., other wagering game machines on the communications network) accessible to the wagering game machine 460.

Additional Example Embodiments

According to some embodiments, a wagering game system ("system") can provide various example devices, operations, etc., to manage contextual wagering game information. The following paragraphs enumerate some possible embodiments.

In some embodiments, the system can dynamically prevent content from occurring. For example, the system can decide to not open an application if another application, with a substantially similar category, is already open (e.g., only one window with advertisements). The system can provide controls for the player to override this functionality or enable the functionality (e.g., provide a "do not interrupt" setting that will prevent certain types of celebratory effects, such as those not related to game wins by the player).

In some embodiments, the system can dynamically cause content to go away so that it can be replaced with other content.

In some embodiments, the system can dynamically share functionality (e.g., (e.g., share game functionality, share funding functionality, etc.) or objects associated with functionality. For example, if a high-roller application opens because of specific events, then the high-roller application can push high-roller advertisement graphics to other applications. In another example, if a player opts into a progressive in one application, then that application could push the decision to opt into the progressive to other applications. In another example, if a player opens specific funding applications, such as a personal banking application, (e.g., a PayPal™ account), a checking account application, a credit card application, etc., then other applications can dynamically accept the form of payment associated with the funding application. In another example, one application can transfer code to another application or activate specific features (e.g., the expanding wild element 142 that is applied to the feature to the wild element 147 of FIG. 1). In some embodiments, the system can pass a localization plug-in (e.g. for language) from one application to another.

In some embodiments, the system can share interpretation of information used by a first application to a second application (e.g., share how to perform tasks, publish interpretations of player input, dynamically adapt features to the published interpretations, etc.). For example, the system can detect that a first application uses a player control device (e.g. a wand, a pointer, a joystick, etc.) that another application does not recognize. The first application can determine a relational mapping between what the inputs of the player control device mean to the first application and what equivalent inputs devices would be for the second application. The first application can then explain to the second application the manner in which the first application interprets the player input compared to a manner in which the second application interprets the player input. For example, the first application can explain what the inputs of a player control device mean based on the functionality of the first application and the functionality of the second application (e.g., a wand tap in the first application is equivalent to a press of a "spin" button in the second application, movement of the wand in the first application equates to touch-screen coordinates in the second application, etc.). In another example, if a first application knows how to work with virtual trophies or virtual assets, then the first application can teach a second application how to work with the virtual trophies or assets. In another example, if a first application detects a player setting/preference (e.g., detects change to larger font size, or volume preference, etc.) either through analysis of player activity, or through direct player indication, then the first application can broadcast that information to other applications to use the setting and/or how to more effectively analyze the player's activity. In another example, a first application can determine how to convert money and share that information with another application In some embodiments, the system can dynamically change content based on sponsorship. For example, a sponsor of a product may receive prioritized or preferential treatment. For instance, the system can detect that first content, presented by a first application, indicates that a player prefers a specific brand of product and analysis indicates that the player is likely going to purchase the specific brand of product within a time frame. A second application may detect a subscription level by a manufacturer of a second, competing, product. The subscription level may specify that the manufacturer has paid a specific amount of money to prioritize advertisement of their product over other products, within a time frame during which the player is likely to purchase the specific product.

Figure 6:
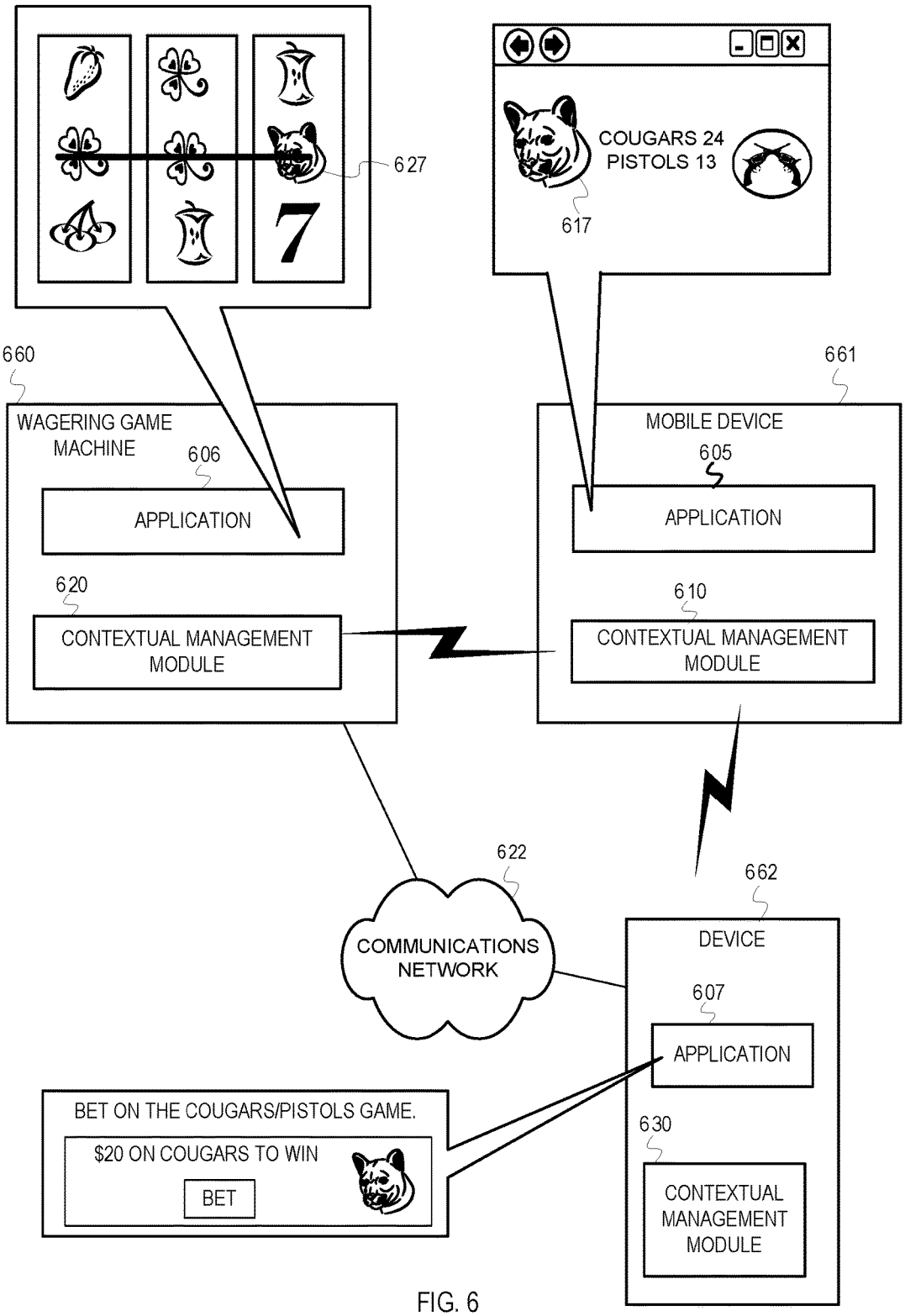
FIG. 6 is an illustration of contextual updating of content via mobile device, wagering game machine, and other device, according to some embodiments.

In some embodiments, the system can dynamically change content based on what occurs on a peripheral device and/or a personal device (e.g., a mobile device, a player's phone, etc.). For example, a location application on a mobile phone may detect that a location of the player is by a sports bar. In another example, a web browser on the mobile phone can indicate that a player is checking sports scores. As a result, the system can launch an application on a wagering game machine and/or on the mobile phone, for sports betting. For example, FIG. 6 illustrates a mobile device 661 that communicates with various devices connected to a communications network, such as a wagering game machine 660 and a device 662. The wagering game machine 660 may be connected to a peripheral device 663. The mobile device 661 may also be referred to as a handheld device, a handheld computer or simply a handheld. In some embodiments, the mobile device 661 is a pocket-sized computing device, having a display screen with touch input and/or a miniature keyboard. Some examples of the mobile device 661 may include, but are not limited to, a smartphone, a personal digital assistant, a mobile computer, a mobile internet device, a portable media player, a mobile phone, etc. In some embodiments, the mobile device 661 belongs to a casino patron, or user, and not to a casino entity or a wagering game provider (e.g., is not a mobile or portable wagering game machine). The user can carry the mobile device 661 into and out of a casino. The mobile device 661 presents content via an application 605. The wagering game machine 660 presents content via an application 606. The device 662 presents content via application 607. A contextual management module 610, associated with the mobile device 661, is configured to communicate with the application 605, the application 606 associated with the wagering game machine 661, and the application 607 associated with the device 662. For example, contextual management module 610 publishes contextual data about what is occurring about the content for the application 605. Further contextual management module 610 also receives published data from the applications 606 (via the contextual management module 620) and via the content for the application 607 (via a contextual management module 630). The device 662 may be, for instance, a table-top device at a bar at a casino, that performs sports betting via the application 607 (e.g., a bet on a sports team named the "Cougars"). The mobile device 661 detects the sports betting and the application 605, for example, responds by presenting sports scores on a browser application on the mobile device 661 (e.g., sports scores for the "Cougars" game as well as a logo 617). Later, when a player who carries the mobile device 661 brings the mobile device 661 into proximity to the wagering game machine 660, the application 606 detects that the application 605 recently presented sports scores and content via published information about a browsing history. Further, the application 606 detects, such as from a log stored on the mobile device 661, that a bet was placed on the "Cougars" to win. The application 606, therefore, assumes that a player logged in to the wagering game machine 660 prefers the "Cougars" sports team. In some embodiments, the application 606 can also read a player profile to detect a favorite sports team. The application 606 may respond dynamically by presenting sports related content and/or changing a game theme to be a sports theme. For example, the application 606 selects the logo 617 and inserts it as a wild slot element 627.

In some embodiments, the system can dynamically affect peripheral devices, such as modifying the automatic movement of a wagering game machine's chair based on what is happening in other applications.

In some embodiments, the system can dynamically update celebratory content, such as effects on emotive lighting, bank end-cap displays, metascreens, etc.

In some embodiments, the system can dynamically adjust sound or volume of all applications based on audio occurring from other applications or from ambient sounds. For example, if one game has a specific audio track playing, based on what happens in another window, then the audio track changes to a different environment, adds another track, changes musical keys or scores to match those playing on other applications, etc.

In some embodiments, the system can dynamically modify a configuration of an application window and manage priority of windows, (e.g., where and when to move or place a window if the window is too close or encroaching on space of another window, such as covering up an important button).

In some embodiments, the system can police whether any application is not following group rules or trying to dominate dynamic updating (e.g. the system can decide that there cannot be more than a specific number of metatags in any given application content).

Additional Example Operating Environments

This section describes example operating environments, systems and networks, and presents structural aspects of some embodiments.

Wagering Game Machine Architecture

Figure 7:
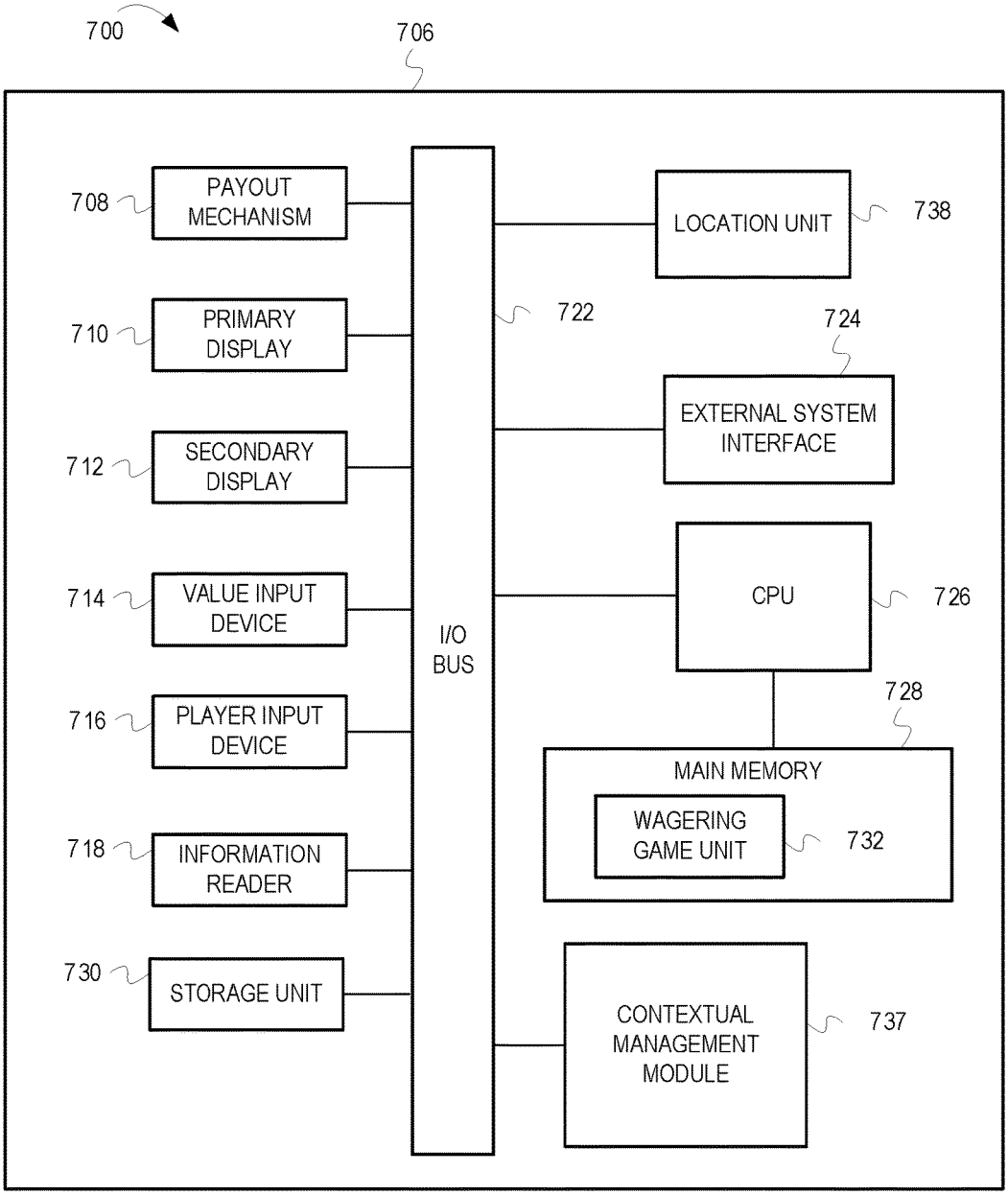
FIG. 7 is an illustration of a wagering game machine architecture 700, according to some embodiments.

FIG. 7 is a conceptual diagram that illustrates an example of a wagering game machine architecture 700, according to some embodiments. In FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In some embodiments, the wagering game unit 732 can present wagering games, such as video poker, video blackjack, video slots, video lottery, reel slots, etc., in whole or part.

The CPU 726 is also connected to an input/output ("I/O") bus 722, which can include any suitable bus technologies, such as an AGTL+frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems (e.g., wagering game networks). The external system interface 724 can include logic for exchanging information over wired and wireless networks (e.g., 802.11g transceiver, Bluetooth transceiver, Ethernet transceiver, etc.)

The I/O bus 722 is also connected to a location unit 738. The location unit 738 can create player information that indicates the wagering game machine's location/movements in a casino. In some embodiments, the location unit 738 includes a global positioning system (GPS) receiver that can determine the wagering game machine's location using GPS satellites. In other embodiments, the location unit 738 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 7, in some embodiments, the location unit 738 is not connected to the I/O bus 722.

In some embodiments, the wagering game machine 706 can include additional peripheral devices and/or more than one of each component shown in FIG. 7. For example, in some embodiments, the wagering game machine 706 can include multiple external system interfaces 724 and/or multiple CPUs 726. In some embodiments, any of the components can be integrated or subdivided.

In some embodiments, the wagering game machine 706 includes a contextual management module 737. The contextual management module 737 can process communications, commands, or other information, where the processing can manage contextual wagering game information.

Furthermore, any component of the wagering game machine 706 can include hardware, firmware, and/or machine-readable storage media including instructions for performing the operations described herein.

Wagering Game Machine

Figure 8:
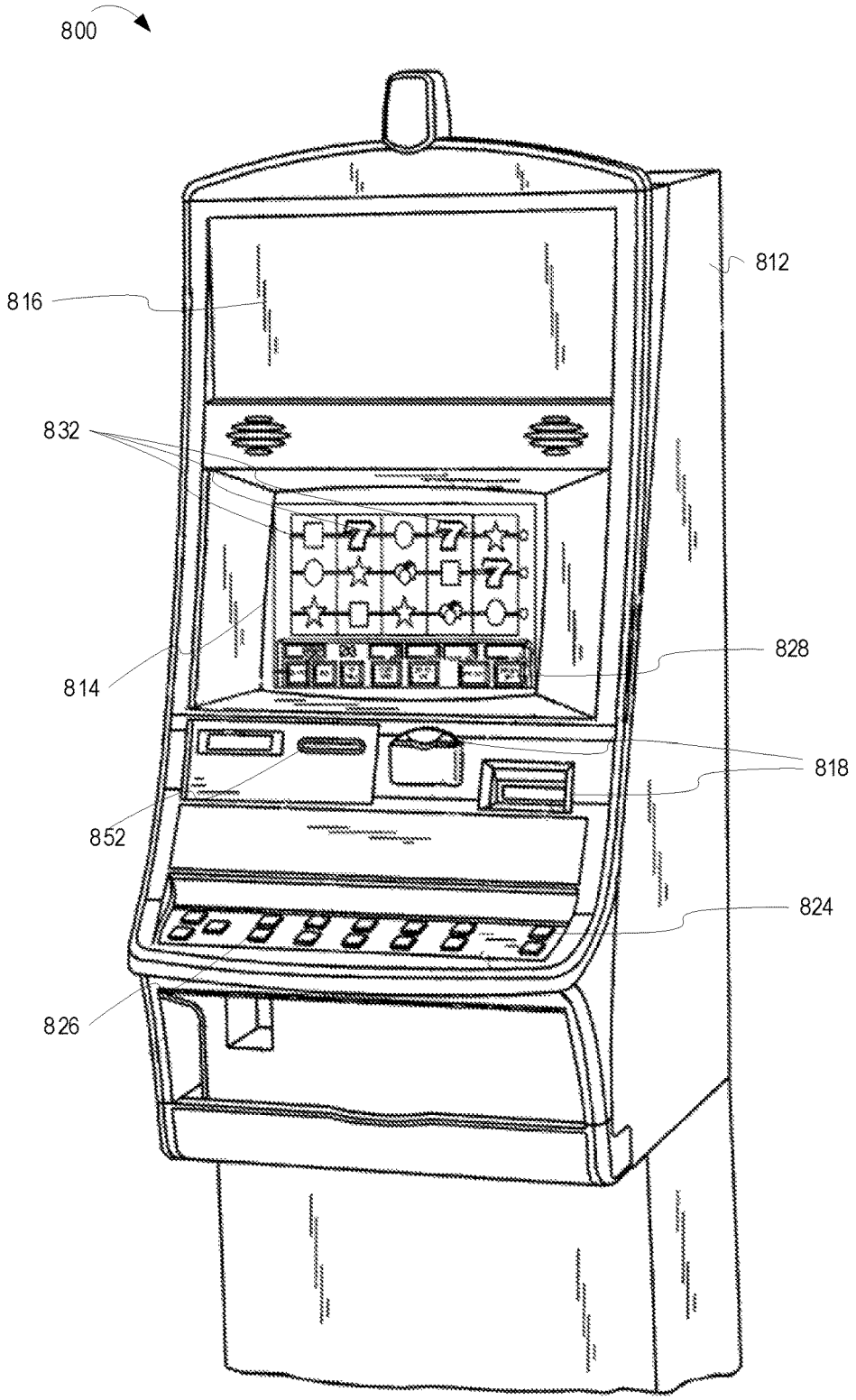
FIG. 8 is an illustration of a wagering game machine 800, according to some embodiments.

FIG. 8 is a conceptual diagram that illustrates an example of a wagering game machine 800, according to some embodiments. Referring to FIG. 8, the wagering game machine 800 can be used in gaming establishments, such as casinos. According to some embodiments, the wagering game machine 800 can be any type of wagering game machine and can have varying structures and methods of operation. For example, the wagering game machine 800 can be an electromechanical wagering game machine configured to play mechanical slots, or it can be an electronic wagering game machine configured to play video casino games, such as blackjack, slots, keno, poker, blackjack, roulette, etc.

The wagering game machine 800 comprises a housing 812 and includes input devices, including value input devices 818 and a player input device 824. For output, the wagering game machine 800 includes a primary display 814 for displaying information about a basic wagering game. The primary display 814 can also display information about a bonus wagering game and a progressive wagering game. The wagering game machine 800 also includes a secondary display 816 for displaying wagering game events, wagering game outcomes, and/or signage information. While some components of the wagering game machine 800 are described herein, numerous other elements can exist and can be used in any number or combination to create varying forms of the wagering game machine 800.

The value input devices 818 can take any suitable form and can be located on the front of the housing 812. The value input devices 818 can receive currency and/or credits inserted by a player. The value input devices 818 can include coin acceptors for receiving coin currency and bill acceptors for receiving paper currency. Furthermore, the value input devices 818 can include ticket readers or barcode scanners for reading information stored on vouchers, cards, or other tangible portable storage devices. The vouchers or cards can authorize access to central accounts, which can transfer money to the wagering game machine 800.

The player input device 824 comprises a plurality of push buttons on a button panel 826 for operating the wagering game machine 800. In addition, or alternatively, the player input device 824 can comprise a touch screen 828 mounted over the primary display 814 and/or secondary display 816.

The various components of the wagering game machine 800 can be connected directly to, or contained within, the housing 812. Alternatively, some of the wagering game machine's components can be located outside of the housing 812, while being communicatively coupled with the wagering game machine 800 using any suitable wired or wireless communication technology.

The operation of the basic wagering game can be displayed to the player on the primary display 814. The primary display 814 can also display a bonus game associated with the basic wagering game. The primary display 814 can include a cathode ray tube (CRT), a high resolution liquid crystal display (LCD), a plasma display, light emitting diodes (LEDs), a three-dimensional (3D) display, or any other type of display suitable for use in the wagering game machine 800. Alternatively, the primary display 814 can include a number of mechanical reels to display the outcome. In FIG. 8, the wagering game machine 800 is an "upright" version in which the primary display 814 is oriented vertically relative to the player. Alternatively, the wagering game machine can be a "slant-top" version in which the primary display 814 is slanted at about a thirty-degree angle toward the player of the wagering game machine 800. In yet another embodiment, the wagering game machine 800 can exhibit any suitable form factor, such as a free standing model, bar top model, mobile handheld model, or workstation console model.

A player begins playing a basic wagering game by making a wager via the value input device 818. The player can initiate play by using the player input device's buttons or touch screen 828. The basic game can include arranging a plurality of symbols 832 along a pay line, which indicates one or more outcomes of the basic game. Such outcomes can be randomly selected in response to player input. At least one of the outcomes, which can include any variation or combination of symbols, can trigger a bonus game.

In some embodiments, the wagering game machine 800 can also include an information reader 852, which can include a card reader, ticket reader, bar code scanner, RFID transceiver, or computer readable storage medium interface. In some embodiments, the information reader 852 can be used to award complimentary services, restore game assets, track player habits, etc.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form readable by a machine (e.g., a wagering game machine, computer, etc.). For example, machine-readable storage media includes read only memory (ROM), random access memory (RAM), magnetic disk storage media, optical storage media (e.g., CD-ROM), flash memory machines, erasable programmable memory (e.g., EPROM and EEPROM); etc. Some embodiments of the invention can also include machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating an electronic gaming system, said method comprising:

providing, for presentation via one or more electronic display devices associated with the gaming system, first digital content for a first application that is independent from a second application that concurrently presents second digital content via the one or more electronic display devices;

intercepting, by the first application, data associated with the second digital content;

determining, via one or more electronic processing units of the gaming system and based on the data, a relationship between the first digital content and the second digital content; and causing the second application to automatically modify presentation of the second digital content in response to determining the relationship.

2. The method of claim 1, wherein the first digital content is controlled by a first content controller associated with the first application, wherein the intercepting the data comprises intercepting one or more of a metatag or a category code assigned to the second digital content by a second content controller for the second application.

3. The method of claim 2, wherein the relationship between the first digital content and the second digital content relates to a game-play element of a wagering game.

4. The method of claim 1, wherein the causing the second application to automatically modify the presentation of the second digital content comprises:

generating, by the first application via at least one of the electronic processing units, one or more of a category code and a metatag based on a result of the evaluation of the data associated with the second digital content; and communicating the one or more of the category code and the metatag to the second application via at least one of the electronic processing units, wherein the second application is configured to utilize the one or more of the category code and the metatag to make a decision to automatically modify the presentation of the second digital content.

5. The method of claim 1, wherein the causing the second application to automatically modify the presentation of the second digital content comprises:

automatically determining, by at least one of the electronic processing units, that the second application is not controlled by the first application; and in response to determining that the second application is not controlled by the first application, communicating to the second application an electronic instruction to modify the presentation of the second digital content based on the relationship.

6. The method of claim 1, wherein the determining the relationship comprises determining that an amount by which a gaming funds balance increases from the first digital content corresponds to a type of advertisement to provide via the second digital content.

7. The method of claim 1, wherein the determining the relationship comprises determining that a level of game achievement in a wagering game presented via the first digital content corresponds to a type of non-game promotional offer to provide via the second digital content.

8. The method of claim 1, wherein the determining the relationship comprises determining that a time at which a purchase was made via the first digital content corresponds to a timing threshold value for when to provide a type of information via the second digital content.

9. The method of claim 1, wherein the determining the relationship comprises determining that a social communication made via the first digital content corresponds to one or more of a graphical element, an invitation, a game suggestion, or an offer to connect with a player account to present via the second digital content.

10. The method of claim 1, wherein a first of the first application and the second application is a wagering game application, and wherein a second of the first application and the second application is a non-game application.

11. The method of claim 1, wherein the first application is a first wagering game application, and wherein the second application is a second wagering game application.

12. The method of claim 11, wherein the causing the second application to automatically modify presentation of the second digital content comprises causing modification to an appearance of a wagering game play element of the second digital content.

13. A gaming system comprising:

one or more processor;

an electronic display device; and a memory storage device configured to store instructions, which when executed by the processor, cause the gaming system to perform operations for controlling the gaming system, the instructions comprising instructions to provide, for presentation via the electronic display device, first digital content for a first application that is independent from a second application that concurrently presents second digital content via the electronic display device concurrently;

instructions to intercept, by the first application, data associated with the second digital content;

instructions to determine, via at least one of the processors and based on the data, a relationship between the first digital content and the second digital content, and instructions to cause the second application to modify presentation of the second digital content in response to the determination of the relationship.

14. The gaming system of claim 13, wherein the first digital content is controlled by a first content controller associated with the first application, and wherein the instructions further include instructions to intercept one or more of a metatag or a category code assigned to the second digital content by a second content controller for the second application.

15. The gaming system of claim 14, wherein the relationship between the first digital content and the second digital content relates to a game-play element of a wagering game.

16. The gaming system of claim 13, wherein the instructions further include:

instructions to generate, by the first application, one or more of a category code and a metatag based on a result of the evaluation of the data associated with the second digital content; and instructions to communicate the one or more of the category code and the metatag to the second application, wherein the second application is configured to utilize the one or more of the category code and the metatag to modify the presentation of the second digital content.

17. The gaming system of claim 13, wherein the instructions further comprise:

instructions to automatically determine that the second application is not controlled by the first application; and instructions to in response to determination that the second application is not controlled by the first application, communicate to the second application an electronic instruction to modify the presentation of the second digital content based on the relationship.

18. The gaming system of claim 13, wherein the the instructions to determine the relationship further include instructions to determine that an amount by which a gaming funds balance increases from the first digital content corresponds to a type of advertisement to provide via the second digital content.

19. The gaming system of claim 13, wherein the instructions further include instructions to determine that a level of game achievement in a wagering game presented via the first digital content corresponds to a type of non-game promotional offer to provide via the second digital content.

20. The gaming system of claim 13, wherein the instructions to determine the relationship further include instructions to determine that a time at which a purchase was made via the first digital content corresponds to a timing threshold value for when to provide a type of information via the second digital content.

* * * * *